United States Patent [19]

Peek et al.

[11] 4,027,125

[45] May 31, 1977

[54] GAS INSULATED CIRCUIT BREAKER

[75] Inventors: Henry L. Peek, Brandon; Kanti V. Mehta, Jackson; John J. Abdou; Amrut R. Patel, both of Brandon, all of Miss.

[73] Assignee: Allis-Chalmers Corporation, Milwaukee, Wis.

[22] Filed: Mar. 17, 1975

[21] Appl. No.: 559,338

[52] U.S. Cl. ..... 200/148 R; 200/145; 200/308; 200/144 AP

[51] Int. Cl.[2] ..... H01H 33/82

[58] Field of Search ..... 340/237, 240; 338/198, 338/200; 200/145, 148 F, 148 BR, 148 R, 148 B, 290, 286, 288, 308, 144 AP; 317/103

[56] References Cited

UNITED STATES PATENTS

| | | | |
|---|---|---|---|
| 3,391,358 | 7/1968 | Bratkowski | 200/148 R |
| 3,493,952 | 2/1970 | Jette | 200/308 |
| 3,769,477 | 10/1973 | Chabala | 200/308 |
| 3,864,534 | 2/1975 | Goodwin, Jr. | 200/145 |

*Primary Examiner*—Gerald P. Tolin
*Attorney, Agent, or Firm*—Robert C. Jones

[57] ABSTRACT

A single pull rod mechanism for actuating the contacts of each phase of a three-phase gas insulated circuit breaker arrangement utilizes acceleration springs only in relation to the second and third phases. Contact parting velocity is measured externally of the breaker thereby providing a check on the breaker operation without breaking the integrity of the gas tight tanks. An eight valve gas system utilizing an integral manifold provides for a complete circulatory arrangement for the high and low pressure gas for all three phases of the circuit breakers increasing the operating reliability of the circuit breaker while simplifying routine and major maintenance procedures.

12 Claims, 8 Drawing Figures

GAS INSULATED CIRCUIT BREAKER

BACKGROUND OF THE INVENTION

The present invention relates to circuit breakers and more specifically to gas insulated circuit breakers utilizing pull rod arrangements for effecting the operation of the circuit breaker contacts of each of the phases. It has been the practice of providing accelerating openings for each pull rod of each phase with the accelerating springs extending externally of the external pull rod box. This arrangement is both unsightly and is subject to damage. For providing a check on the operating characteristics of the breakers, such as the opening velocity of the circuit breaker contacts, it has been necessary to breach the integrity of the gas sealed enclosures to connect necessary apparatus to the contacts of each of the phases. This, of course, requires a relatively long outage of the breaker for accomplishing the required testing. It has also been the practice of providing a gas system for the gas insulated circuit breakers which required a maze of piping that, of course, required a multitude of joints which are highly subject to leakage. Since the gaseous dielectric medium utilized in these types of circuit breakers, such as sulfur hexafluoride, is relatively expensive, loss due to leakage must be avoided both to reduce the cost factor and maintain the integrity of the system.

SUMMARY OF THE INVENTION

It is desirable to be able to combine the operation of the individual phase operating pull rods in a manner to utilize a single operator that actuates all of the pull rods in unison. It is also highly desirable to reduce the use of accelerating springs to a minimum to not only effect a reduction in cost but also to reduce the shock load induced into the system by the accelerating springs. Thus, the present invention is concerned with simplifying the pull rod arrangement to reduce the use of accelerating springs while still maintaining acceptable contact opening velocities. It is further desirable that a measurement of the circuit breaker operating characteristics be accomplished without the necessity of breaching the gas sealed integrity of the enclosures. To this end an externally mounted apparatus is operatively connected to measure the change of velocity with respect to the change in distance of the contacts in an opening movement. This change is amplified and the results indicated on a scope or recorder. An improved gas system is provided which materially increases the reliability and control of the insulating gas utilized in the sealed circuit breakers. The system includes an arrangement of eight manually actuatable valves and incorporates a manifold which together result in improved system reliability.

DESCRIPTION OF THE INVENTION

Figure 1:
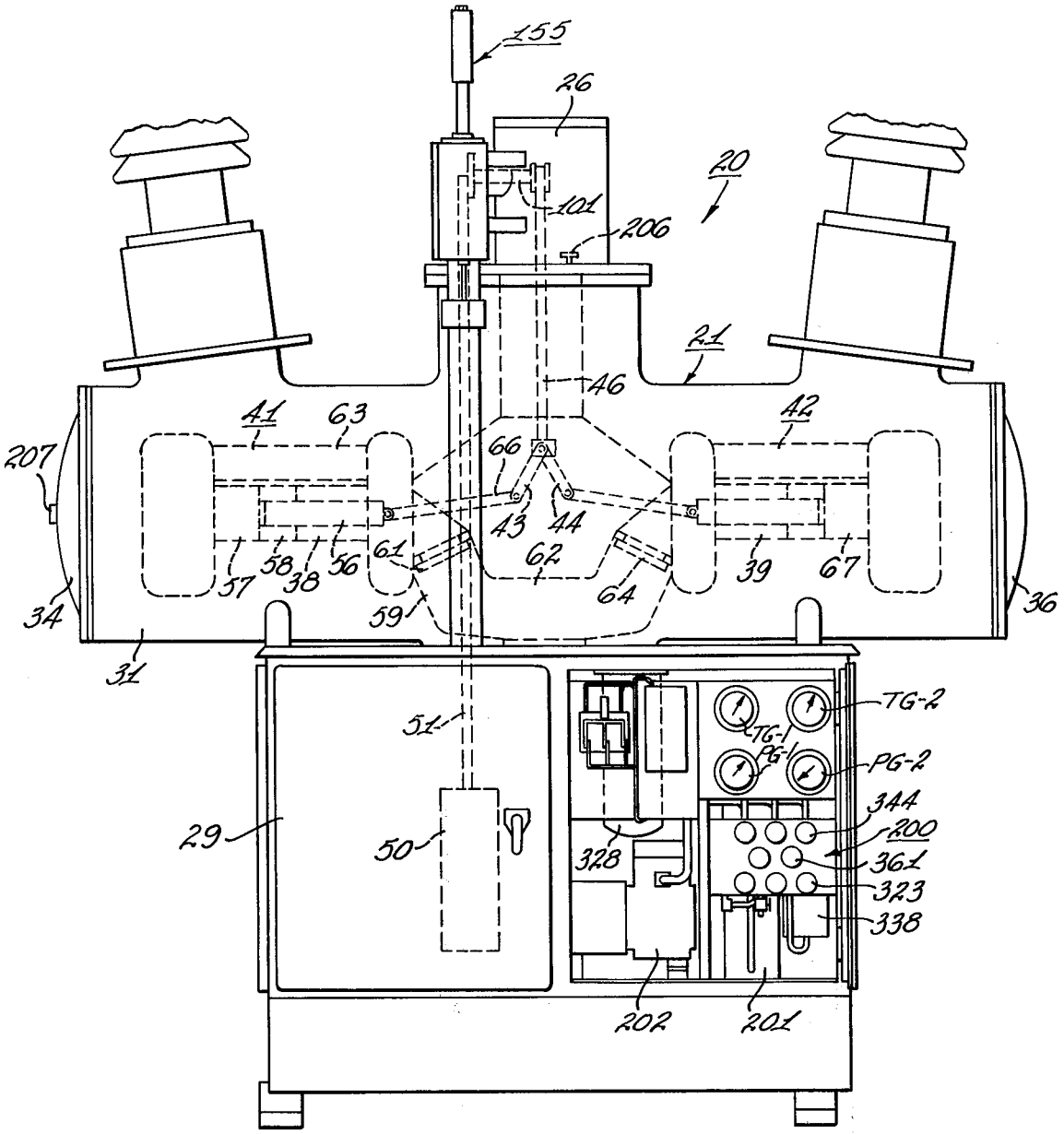
FIG. 1 is a view in front elevation of a three-phase circuit breaker arrangement showing the control cabinet in which the contact operating mechanism and the gas system are housed.
Figure 2:
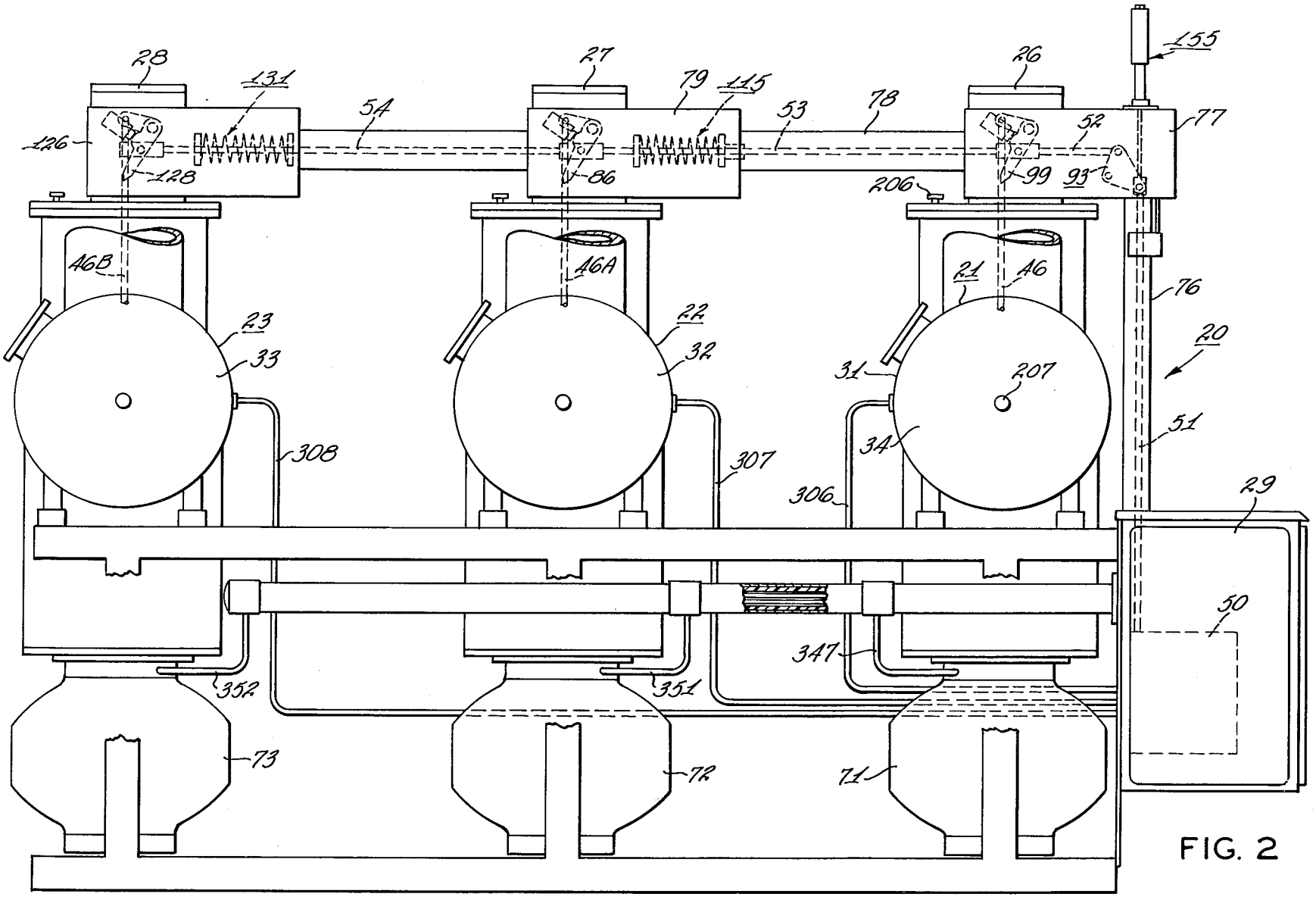
FIG. 2 is a view in side elevation of the three-phase circuit breaker arrangement of FIG. 1 showing the external pull rod operating enclosures associated with each phase.

Referring to FIGS. 1 and 2, there is depicted a high voltage transmission circuit breaker arrangement 20 comprising three gas sealed circuit breakers 21, 22, and 23, one for each phase of a three-phase installation. All components are supported and contained in electrically interconnected metallic housings which are solidly connected to the frame of the substation structure. The live parts of the components are insulated from their metal housings by suitable insulating material and by $SF_6$ gas. Each circuit breaker employs a two-pressure system which is sealed and may be separated from all of the other components of the system. Thus, a gas loss from one unit not affect any other unit. In addition, the operating sequence of the contacts of each circuit interrupter module as well as the operation of associated high pressure gas blast valves are controlled by actuating means mounted in top structures 26, 27, and 28. A control cabinet 29 houses the gas controls, gauges, hydraulic motor as well as the power sources for the associated hydraulic motors.

For a detailed description of a circuit breaker arrangement usable herein reference may be had to U.S. Pat. No. 3,864,534.

Each of the circuit breakers 21, 22, and 23 are similar and the description of the circuit breaker 21 will also apply to the circuit breakers 22 and 23; like parts being identified by the same numeral followed by a subscript.

The circuit breaker, such as the circuit breaker 21, includes a gas filled metallic enclosure 31 of tubular form. Each end of the enclosure 31 is provided with a hinged access door 34 and 36 for providing entry into the enclosure. Within the enclosure 31, there are disposed, in this particular illustration, two series connected identical circuit interrupters 38 and 39 which are operated simultaneously to contact closed or contact open positions. Closing resistors and/or capacitors 41 and 42 may be connected in parallel with interrupters 38 and 39. The contacts of the interrupters 38 and 39 and the contacts (not shown) of the resistors 41 and 47 are moved in proper sequence to open or closed positions by operating links 43 and 44 actuated by a common rod 46. The rod 46 is operatively connected to a source, such as an operator generally indicated by the reference number 50 located within the control cabinet 29 via a vertical motion transmitting rod 51 and horizontally disposed series of interconnected pull rods 52, 53, and 54. Operators such as 50 are well known and for a more detailed description of an operator suitable for use herein reference may be had to U.S. Pat. No. 3,457,531.

The contacts within each unit are the same, and the description of the contacts of the circuit interrupter 38 will apply to all contacts. As shown in FIG. 1, a tubular axially movable contact 56 is slidably supported in a conductive metallic housing 57 so as to move relative to a fixed contact 58. The housing 57 and the gas blast valve housing 59 in which an associated displaceable gas valve 61 is located are carried by a centrally disposed housing 62. Resistor 41 has somewhat the same arrangement having an axially movable contact (not shown) engageable with a fixed contact (not shown) located within a housing 63. The interrupter 39 and the associated resistor 42 are identical to the interrupter 38 and its associated resistor 41. It is to be understood that the gas valve housing 62 is also provided with another displaceable gas valve 64. The contact housing 62 is secured to the gas valve housing 57 in a manner such that the rod 66 for the movable contact 56 passes through the casting 62 to operatively connect with the operating linkage 43. In a similar manner, the housing 63 of the resistor 41 is carried by the housing 62 so that actuating linkage 43 associated with the movable resistor contact (not shown) is functionally accessible to the operating linkage 46.

Gas at a relatively high pressure is contained in a tank 71 for the circuit breaker 31 and in tanks 72 and 73 for the circuit breakers 32 and 33, respectively. Each tank communicates with the associated circuit breaker contacts through the respective blast valves.

As previously mentioned, operation of the interrupters and associated resistors in each of the circuit breakers associated with each phase is accomplished by a single operator 50. To this end, the vertical operating rod 51 is operatively disposed within a tubular vertically extending housing 76 that extends upwardly from the control cabinet 29 into an external pull rod box 77 associated with the circuit breaker 31. The lower end of the vertically disposed operating rod 51 is operatively connected to the operator 50 which is operative to effect axial movement of the rod 51 on a signal received from a control section (not shown). The upper end of the rod 51 within the external pull rod box 77 is operatively connected by suitable linkage to the horizontally disposed pull rod 52. Within the external pull rod boxes each of the rods 52, 53, and 54 have operative connection with associated ones of laterally extending horizontal levers, such as the lever 86 within the box 79, that are pivotally supported in structures 26, 27, and 28. Internally, the levers, such as the lever 86, are operatively connected by a suitable linkage mechanism (not shown) to the associated vertical actuating rods 46, 46A, and 46B that extend downwardly into the circuit breakers. Thus, upon a signal, the hydraulic operator 50 within the cabinet 29 will be caused to operate in a contact opening operation.

Figure 3:
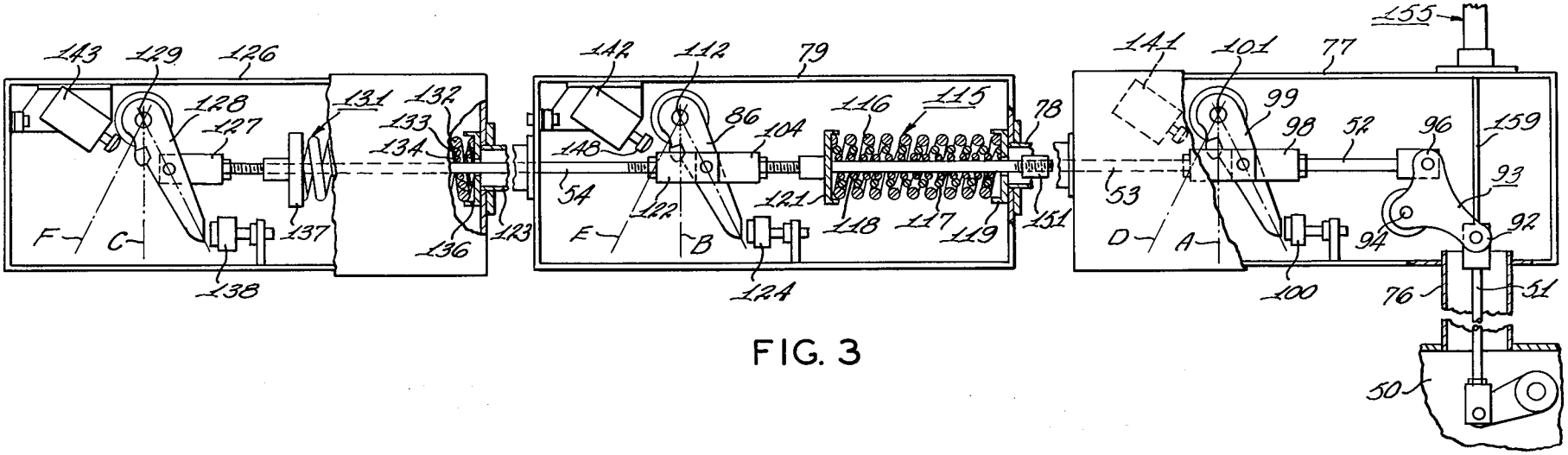
FIG. 3 is a detailed view of the external pull rod operating mechanism with side covers removed to show internal components, the showing is made with the circuit breaker contacts in closed position.

As shown in detail in FIG. 3, the vertical rod 51 is disposed within a protective casing 76 that extends between the control cabinet 29 and the external pull rod box 77 associated with the first phase circuit breaker 21. The rod 51 at its lower end is operatively connected to the hydraulic operator 50 and at its upper end to one end 92 of a bell crank 93. As shown, the bell crank 93 is supported on a horizontally disposed pin 94 for pivotal movement relative to the pin. The other end 96 of the bell crank receives the end of the pull rod 52. At its opposite end, the pull rod 52 is threadedly engaged in the end of a connector 98 that has a pivotal connection with an actuating lever arm 99. The actuating arm 99 is secured to the extending end of a shaft 101 which is journalled in the side wall of the external pull rod box 77 and arranged extending into the top structure 26 of the circuit breaker 21 in sealed relationship therewith. The end of the shaft 101 within the structure 26 is operably connected to the actuating rod 46, which, in turn, is connected to the operating linkage 43 and 44. For a more detailed description of the arrangement, reference may be had to U.S. Pat. No. 3,852,549.

As shown in FIG. 3, the lower end of the lever arm 99 is disposed against an adjustable overtravel stop 124 which operates to limit the overtravel of the lever arm 99 and thereby the pull rod past contact fully closed position. Thus, when the interrupter contacts are in their desired closed position, the overtravel stop 124 is adjusted to engage the lower end of the lever 99 thereby limiting the overtravel of the contacts beyond closed position by a resilient shock absorbing means such as the shock absorber 142.

The opposite end of the connector 98 threadedly receives the threaded end of the pull rod 53 associated with the second phase circuit breaker 22. The pull rod 53 extends through the end of the external pull rod box 77 and through the tubular housing 78 and into the external pull rod box 79 associated with the circuit breaker 22. The end of the pull rod 53 within the external pull rod box 79 is threaded as at 103 and is threadedly engaged in the end of a connector 104. Connector 104 is similar to the connector 98 and has a pivotal connection with an actuating lever arm 86 associated with circuit breaker 22. The lever arm 86 is connected to a shaft 112 which is constructed and arranged in a manner similar to the shaft 101.

Within the external pull rod box 79 and mounted around the pull rod 53 is an accelerating spring means 115. The spring means 115 comprises an assembly of nested coiled springs 116, 117, and 118 which operate to impart an accelerated opening movement to the pull rod 53. The ends of the spring means 115 abut a thrust cup 119 which serves to retain the ends of the nested spring in axial alignment with the pull rod 53. The opposite end of the nested springs are retained in a thrust cup 121 which is backed up by a nut 120 which is threadedly engaged in the threaded porton 103 of the pull rod 53. By adjusting the nut 120 either rightwardly or leftwardly, the length of the nested coiled springs when compressed may be adjusted to establish the amount of energy that may be stored in the spring means 115.

The opposite end 122 of the connector 104 threadedly receives the end of the pull rod 54 which is associated with the third phase circuit breaker 23. The pull rod 54 extends through the end wall of the external pull rod box 79 and a housing 123 into the external pull rod box 126 associated with the third phase circuit breaker 23. Within the external pull rod box 126 the threaded end of the pull rod 54 is engaged in a connector 127, which, in turn, has a pivotal connection with a lever arm 128. Arm 128 is secured to the extending end of a rotatable shaft 129 that is connected to effect opening and closing movements of the contacts associated with the circuit breaker 23 and is similar to the arrangement of the circuit breakers 21 and 22.

A spring means 131 comprising coaxial nested springs 132, 133, and 134 is disposed within the external pull rod box 126 and is mounted around the pull rod 54. Centering of the nested springs to maintain them substantially coaxial with the rod 54 is accomplished by means of a thrust cup 136 which is loosely mounted on the rod 54 and abuts the end wall of the enclosure 126 and a second thrust cup 137 which encompasses the left end of the spring and is retained by a nut which threadedly engages on rod 54, as viewed in FIG. 3. The amount of compression afforded to the spring means 131 is adjusted by moving the thrust cup 137 either rightwardly or leftwardly as may be required.

The lower end of the lever arm 128 is disposed to engage the overtravel stop 138 when the contacts associated with circuit breaker 23 are in full closed position. Thus, each of the circuit breakers 21, 22, and 23 has individual stops to establish fully closed travel limits. This arrangement compensates for differences in component parts in each breaker which may vary within limits due to manufacturing tolerances. However, once the contact fully closed position is established for each of the circuit breakers 21, 22, and 23, and the stops 100, 124, and 138 adjusted, the engagement and closed positions of all contacts will be the same. The adjustment of the individual circuit breakers is necessary because the travel of the phases will be somewhat different from each other. This is true because the contact closed position of each circuit breaker is adjusted with the associated acceleration springs compressed and the pull rods have some stretch within their elastic limits. The greatest elongation is on the pull rod for pole number 1, the next greatest on pull rod for pole number 2, and the least for the pull rod of pole number 3. The effect of the relaxation of these different stresses causes the contacts associated with the circuit breaker of pole number 3 to travel a slightly shorter distance to open position relative to the slightly longer travel of the contact of the circuit breaker of pole number 2. The contacts of the circuit breaker of pole number 2 travel a slightly shorter distance in relation to the distance that the contacts of the circuit breaker of pole number 1 travel.

The position of the contacts associated with each of the circuit breakers 21, 22, and 23 is reflected in the angular position of the associated lever arms 99, 86, and 128. Thus, the angular position which the lever arms 99, 86 and 128 occupy, as depicted in FIG. 3, is the contact fully closed position. When the arms 99, 86 and 128 are moved in a clockwise direction to a position represented by the broken lines D, E, and F, the associated contacts are in fully opened position.

Figure 4:
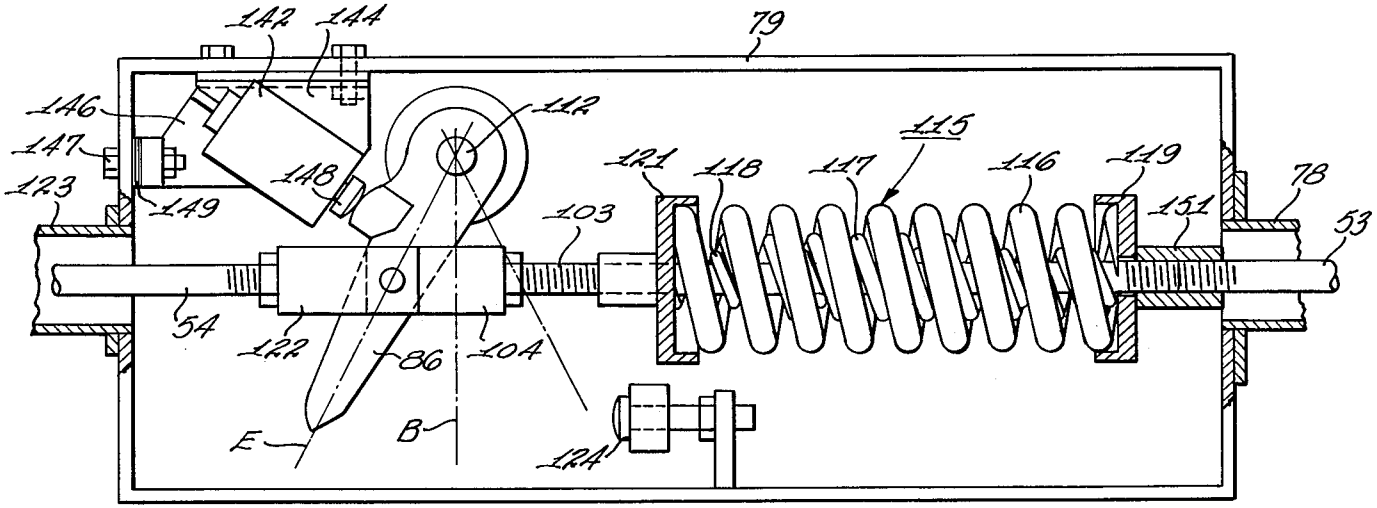
FIG. 4 is an enlarged view with side cover removed of the external pull rod operating mechanism associated with the second phase circuit breaker, the mechanism being shown with the circuit breaker contacts in open position.

To absorb shocks in each system, individual shock absorbers 141, 142, and 143 are provided in each of the external pull rod boxes 77, 79 and 126. The shock absorber 142 associated with the box 79 exemplifies the arrangement of all of the shock absorbers, as shown. The shock absorber 142 is mounted in a bracket 144 which is adjustably bolted to the upper surface of the box 79 for limited rightwardly or leftwardly positioning movement. The bracket 144 is provided with a laterally extending flange 146 into which a bolt 147 threadedly engages. A plurality of spacers 149 interposed between the flange 146 and the end wall of the external pull rod box 79 serve to position the shock absorber relative to the fully open position of the lever arm 86 as indicated in FIG. 4. It will be noted that when the lever arm 86 is in fully closed position as depicted in FIG. 3, the plunger 148 of the shock absorber 142 is in a fully extended or outward position. On the other hand, when the lever arm 86 has been moved to its full open position the lever arm 86 has depressed the plunger 148 of the shock absorber 142 to its full shock absorbing inward limit. Thus, the position of the shock absorber 142 as established by the shims or spacers 148 is important. If the shock absorber 142 is positioned too far to the right, as viewed in FIG. 3, the lever arm 86 will not be able to reach the angular position indicated by the broken line E. Thus, the contacts will not reach a fully open position. On the other hand, if the shock absorber 142 is positioned too far to the left, as viewed in FIGS. 3 and 4, the lever arm 86 will tend to over-travel the position indicated by the broken line E. In this case, the shock absorber will not effect total deceleration of the arm, and a shock load will be imposed upon the movable contacts resulting in possible damage thereto or to the linkage systems 43 and 44.

In the arrangement herein set forth, the combined forces of the spring means 115 and 131 are only required to effect an acceleration of the masses associated with the circuit breaker contacts to effect rapid opening of the contacts. For example, with the pull rods 52, 53, and 54 and, thus, the lever arms 99, 86, and 128 in fully rightwardly position, as depicted in FIG. 3, the contacts associated with each of the circuit breakers 21, 22, and 23 will be fully closed. When the hydraulic operator 50 is signaled to release the pull rods 52, 53, and 54 for effecting the opening of the circuit breaker contacts, the inertia of the component masses must be quickly overcome to effect a two-cycle open movement of the contacts. However, when acceleration of the component masses has been obtained and the contacts have separated, which condition would be when the lever arms reach a vertical position indicated by the broken line B, the stored energy of both of the spring means 115 and 131 is no longer required to complete the opening movement of the contacts. It is also true that the toggle linkage associated with operator 50 is at its greatest mechanical disadvantage at the beginning of the reset stroke in effecting a contact closing operation, and the combined load of compressing both of the spring means 115 and 131 imposes greater stresses on the operating mechanism 50. Thus, to effect an initial opening movement of the circuit breaker contacts, the maximum acceleration obtainable is desirable until contact parting has been effected and thereafter the additional velocity is not required nor desirable.

A means has been conceived to obtain the full benefit of the stored energy in both of the spring means 115 and 131 until the point of contact parting, represented by the vertical broken line B, and thereafter rendering one of the spring means from imparting the balance of its stored energy into the system. To this end, attention is directed to FIGS. 3 and 4 and to spring means 115. As previously mentioned, the thrust cup 119 is mounted on the pull rod 53 in a manner to be freely movable axially with respect to the rod. A nut 151 disposed outside of the external pull rod box 79 and within the housing 78 is secured to the pull rod 53 so as to move with the rod. The nut 151 is positioned on the rod 53 in a manner that as the nut moves with the rod leftwardly in a contact opening movement, the nut will engage the thrust cup 119 when the circuit breaker contacts have parted which condition is indicated by the lever arm 86 being moved angularly in a clockwise direction from the position it occupies as depicted in FIG. 3 to a vertical position indicated by the broken line B. With this condition obtained, the stored energy in the spring means 115 is no longer required and the nut 151 engages the thrust cup 119. At this time, the spring means 115 has only partially expanded and thus has the additional stored energy therein represented by the unexpanded length of the springs. Since the thrust cup 121 is secured to the rod 53 and moves with the rod, and the nut 151 is also secured to the rod 53 and moves with it, the partially expanded spring means 115 is captured between the thrust cup 121 and the nut 151. Thus, the spring means cannot expand further and moves bodily with the pull rod 53. Therefore, the additional movement of the pull rods 52, 53, and 54 and the lever arms 99, 86 and 128 from a contact just separated position indicated by the vertical broken lines A, B, and C to a fully open position indicated by the broken lines D, E and F is accomplished solely by the remaining stored energy in the spring means 131. Thus, the additional velocity that would have been imparted to the system through the spring means 115 is no longer applied and shock load is materially reduced. In addition, when the operator 50 is actuated to move the pull rods rightwardly in a contact closing operation, it is only necessary to work against the single spring means 131 to compress it. This relieves the load in the operator 50 at the time that the associated toggle linkage is at the greatest mechanical disadvantage. The spring means 115 is compressed only after initial closing movement has been initiated.

Figure 5:
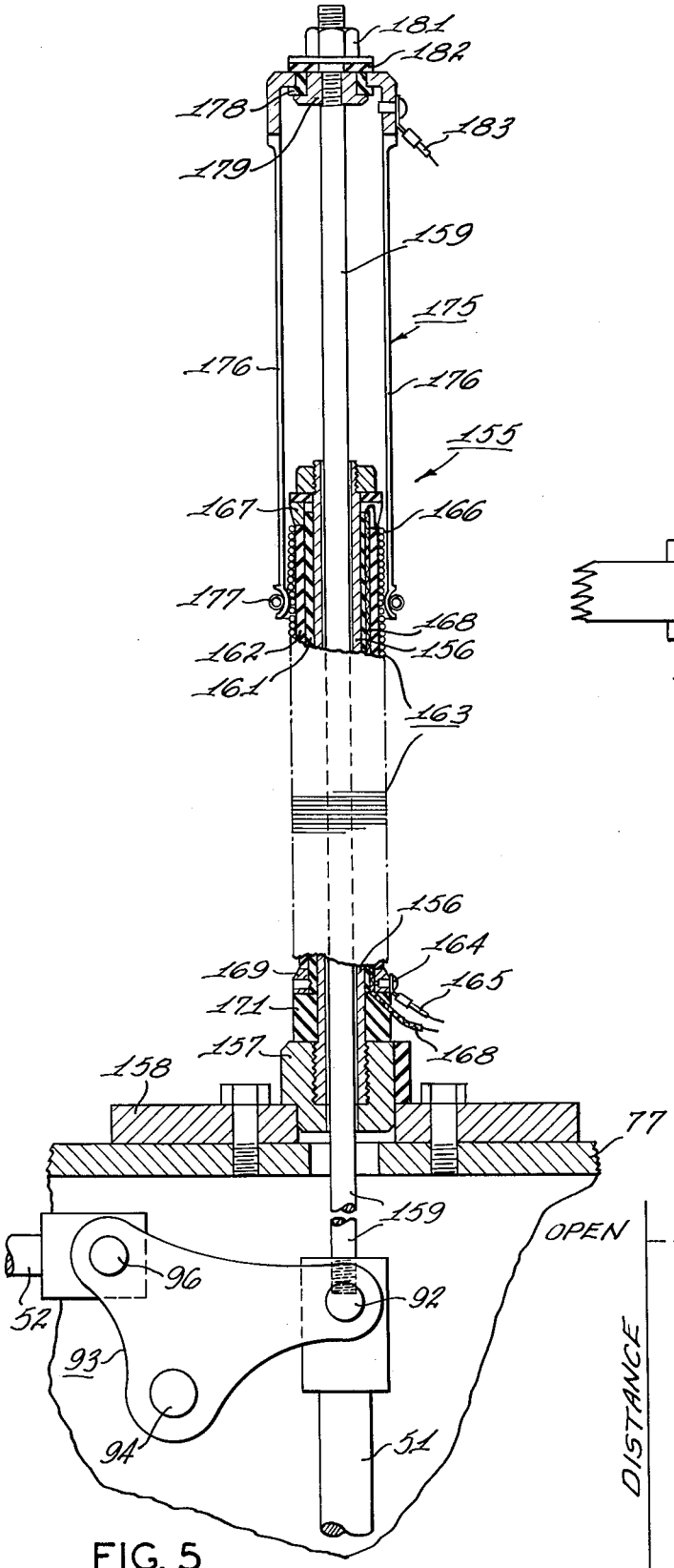
FIG. 5 is a view partially in elevation and partial section of the contact velocity indicator mechanism.

A continuous or periodic check of the opening characteristics of the contacts associated with the circuit breakers 21, 22, and 23 is required. This is accomplished by slide wire indicator means 155 indicated generally in FIG. 2 and shown in detail in FIG. 5. As shown, the indicator 155 comprises a metallic tubular core 156, the lower end of which is threadedly engaged in a fitting 157 that is secured in a mounting plate 158. The mounting plate 158 is adapted to be secured to the top surface of the external pull rod box 77, as shown in FIGS. 2 and 3. An operating rod 159 extends downwardly through the core 156 and through suitable aligned openings in the fitting 157 and the mounting plate 158 and into the interior of the external pull rod box 77. The lower end of the rod 159 is threadedly connected with the vertical pull rod actuating rod 51. Thus, as the pull rods 52, 53, and 54 are moved rightwardly under the influence of the stored energy in the spring means 115 and 131 in a contact opening operation, the rod 51 will move upwardly. As a result, the rod 159 will also be caused to move upwardly at the same velocity as the pull rods 52, 53, and 54 are traveling. Surrounding the metallic core 159 is an insulator tube 161. An insulator sleeve 162 surrounds the insulator tube 161 and acts as a base for a resistance coil 163 which extends substantially over the length of the sleeve. At the lower end the resistance coil terminates in a terminal 164 to which an electrical conductor 165 is electrically connected. The opposite or upper end 166 of the resistance coil 163 terminates in a copper ring 167 that surrounds the insulator tube 161 and abuts the end of the insulator sleeve 162. An electrical conductor 168 having an insulating jacket is electrically connected to the end of the resistance coil within a suitable opening in the upper ring 167. The insulated conductor 168 extends downwardly in a suitable longitudinally extending groove formed in the surface of the insulator tube 161 and extends through another copper ring 169 in which the terminal 164 is engaged. The entire assembly is insulated from metallic fitting 157 by an insulator ring 171. A copper slider or sleeve 175 comprising a plurality of elongated downwardly extending slider fingers 176, two of which are shown, engages the resistance coil and is movable relative to the coil. To maintain good electrical engagement of the fingers 176 with the coil 163, a garter spring 177 encompasses the lower portion of the fingers to maintain them in intimate engagement with the coil. The slider 175 is connected to the upper end of the rod 159 through an insulator bushing 178 and a metallic bushing 179 that has a threaded connection to the rod 159. The entire slider assembly 175 is locked in position to the rod 159 by a nut 181 and an insulator washer 182. An electrical conductor 183 is electrically connected to the upper portion of the slider fingers 176, as shown. In FIG. 5 the slider 175 is in an upwardly displaced position relative to the coil 163 and is in a position to which it has been moved when the rod 51 is moved upwardly in a contact opening movement.

Figure 6:
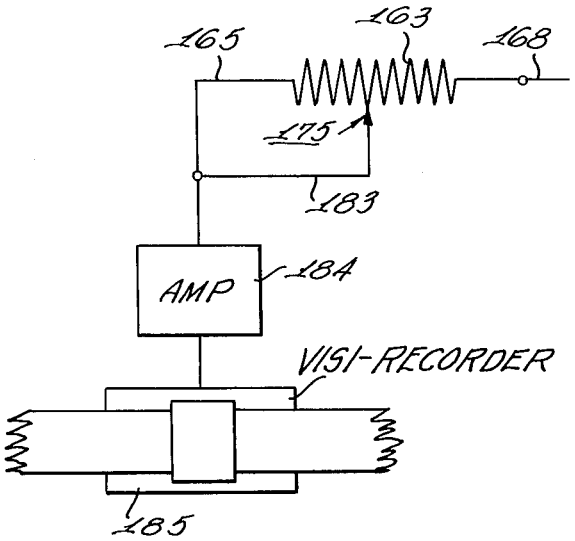
FIG. 6 is a schematic view showing of the velocity indicator of FIG. 5 as connected to an amplifier and a Visirecorder.
Figure 7:
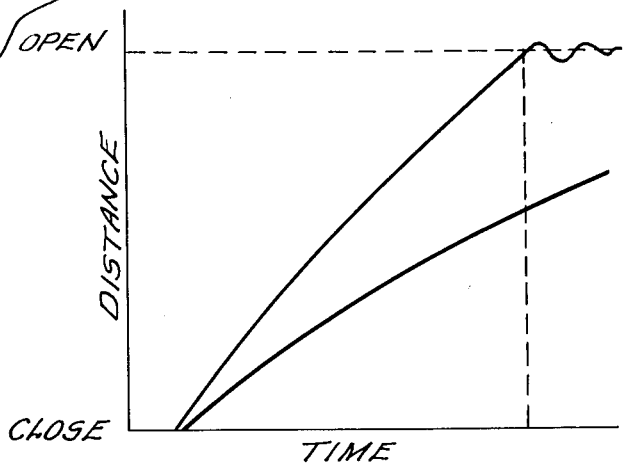
FIG. 7 is a graph showing the relationship of the information provided by the velocity indicator of FIG. 5.

As shown schematically in FIG. 6 the conductor 183 of the slider is connected to an amplifier 184. With the resistor coil 163 energized through the conductor 165, a change in the resistances between the conductor 165 and the conductor 183 as effected by the displacement of the slider 175 from an initial lowermost position on the coil can be sensed. This change is transmitted to the amplifier 184 and amplified and transmitted to the Visi-recorder 185. The Visi-recorder operates to provide a curve plot, such as indicated in FIG. 7, that registers a plot of distance versus time. The changing resistance in the coil 163 is directly proportional to the distance that the slider 175 has traveled on the coil. Thus, the time it took the slider to move a particular distance relative to the coil 163 can be readily ascertained from the plot. Since the slider 175 moves with the pull rods 52, 53, and 54, the contact velocity in an opening movement can be readily seen. Thus, a continuous monitoring of contact velocity can be had if desired and any variation from a normal velocity is easily seen. A variation in contact opening velocity from a norm is an indication that the circuit breaker is not functioning properly and preventive maintenance can be accomplished before serious damage or malfunction occurs.

The gas system shown herein is a two-pressure system and incorporates a unique block-type gas manifold 200 along with other features which increase the operating reliability of the breaker while simplifying both routine and major maintenance procedures. The primary operating functions of the low pressure gas system are: (1) insulation of the live parts of the breaker from ground, and (2) isolation across the open contact gap. The primary function of the high pressure gas system is to maintain a pressure differential above the low pressure system so that the opening of the blast valve causes a high velocity flow of gas through the interrupters to open the circuit.

The low pressure gas system is contained in the low pressure tanks 31, 32, and 33 which house and support each pole unit of the breaker. It is designed with a small size and simple shape to minimize gas volume and enhance its strength as a pressure vessel. The low pressure system is typically designed to operate at approximately 45 psig to assure that the $SF_6$ gas will not liquify at pressures above −40° F. No gas heaters are required in the low pressure system. All three low pressure tanks, 31, 32, and 33 are interconnected to operate as a single low pressure system. The grounded tank design of the breaker minimizes the number of seals necessary.

Figure 8:
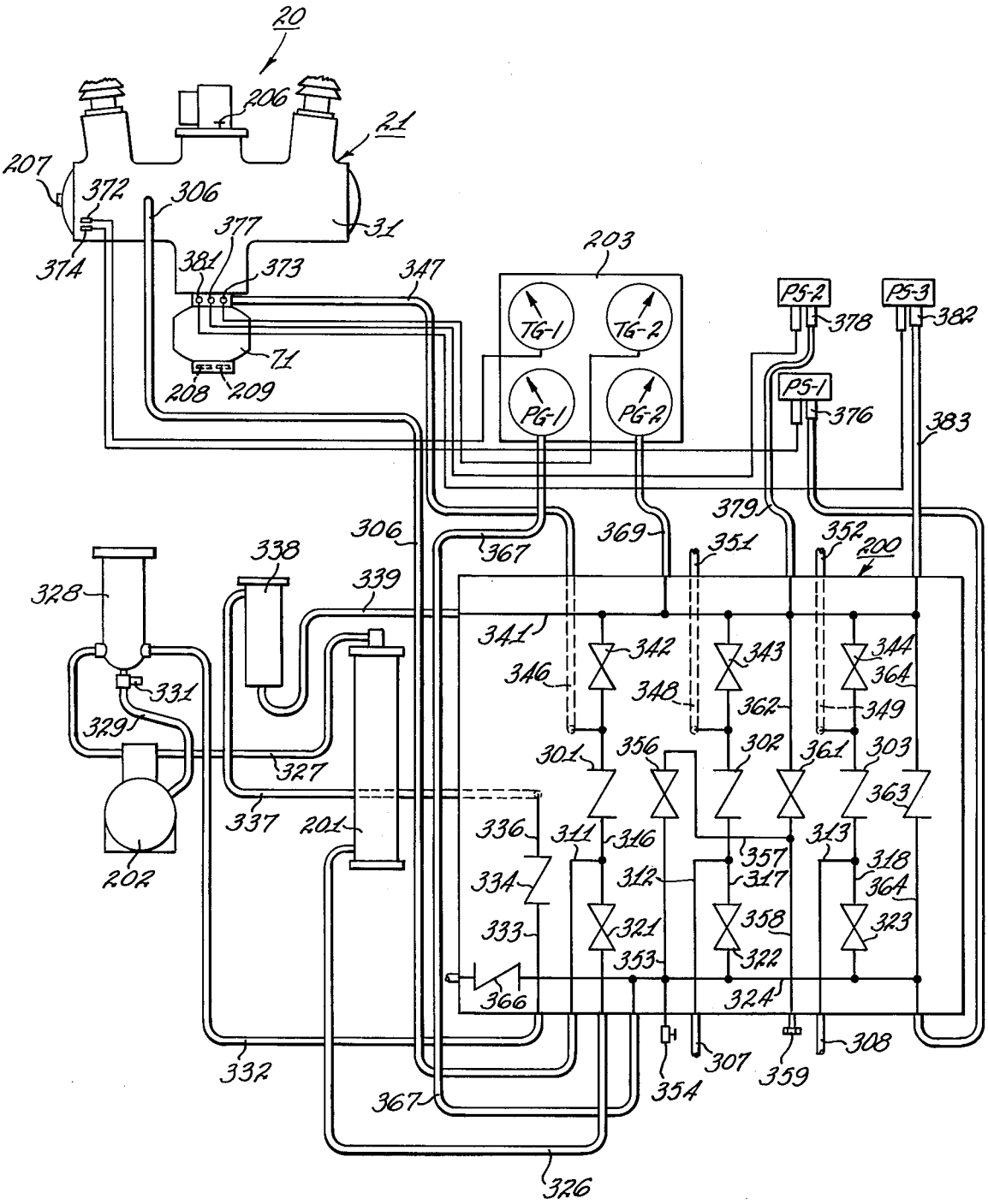
FIG. 8 is a schematic view of the two-pressure gas system in relation to the circuit breaker and showing the various gauges and valves that are located in the manifold block.

The gas density in the low pressure system is protected against falling below a safe operating level due to leakage or pumping action of the compressor by a dual contact switch PS-1. One contact of PS-1 serves to energize an underpressure alarm circuit (not shown). The second contact in PS-1 opens the circuit to the motor of the compressor 202. A panel 203 is shown in FIG. 8 and includes two temperature gauges TG-1 and TG-2. The temperature gauge TG-1 indicates the temperature of gas in the low pressure tanks 31, 32, and 33 while the temperature gauge TG-2 is connected to indicate the temperature of the gas in the high pressure tanks 71, 72, and 73. Gas density in the low pressure system is also indicated in the tank 31 by temperature gauge TG-1 and prssure gauge PG-1. An overpressure relief valve 206 vents the low pressure tank to atmosphere in the event of excessive pressure. In case of extremely rapid rates of pressure rise, such as might be caused by internal arcing, catastrophic failure of the tank is prevented by a pressure calibrated rupture disc 207. The disc breaks to permit rapid venting of the gas fom the vessel in a controlled direction to assure safety of operating personnel. Each low pressure tank has its own relief valve and rupture disc.

Each pole unit of the breaker has a high pressure system which has sufficient gas capacity to provide multiple close-open operations without operation of the compressor. Typical operating pressure for the high pressure system is 250 psig. The required gas pressure for the high pressure system is maintained by control of compressor operation and gas temperature. Compressor operation is controlled by a temperature compensated pressure switch PS-2. The gas temperature is maintained at 55° F or above by a dual heater system comprising a primary heater 208 and a secondary heater 209 located at the bottom of each of the high pressure tanks 31, 32, and 33.

Each heater has a thermostat (not shown) for its individual control. The primary heater is energized when the gas temperature falls to 75° F. The secondary heater is switched on at 65° F. Either heater is capable of keeping the $SF_6$ gas in its gaseous state with ambient temperatures as low as −40° F. In the event of loss of the heater function, a low temperature alarm circuit is actuated at 50° F.

The primary and secondary heater systems are wired to separate control terminals (not shown) so that separate heater supply circuits can be used.

A pair of temperature switches energize an over-temperature alarm at 120° F and open the heater circuits when the gas temperature reaches 160° F.

The rate of heat loss is minimized through careful design of the high pressure system. The high pressure tank is jacketed with plastic foam thermal insulation. The remainder of the system is surrounded by the low pressure gas in the pole unit. This minimizes heating energy requirements and provides extended periods of operation in the event of loss of the heater function.

The small size and vertical orientation of the high pressure system assures effective heating throughout the system by convection mode. It also assures quick return of any liquidfied $SF_6$ to the heater well at the bottom of the high pressure tank where it is reevaporated.

Gas density in the high pressure system is monitored by an underpressure alarm switch and an underpressure lockout switch PS-3 which trips the breaker and locks it in the open position when the gas density in the high pressure system falls to an unsafe operating level. Both of these switches are temperature compensated. The gas density in the high pressure system is also indicated by temperature gauge TG-2 and pressure gauge PG-2.

In the event of excessive pressure in the high pressure system, overpressure relief valves 301, 302, and 303 in the manifold 200 vent the high pressure system into the low pressure system.

The gas flow is from the low pressure enclosures 31, 32, and 33 via connecting piping 306, 307, and 308 that register with associated passages 311, 312, and 313, respectively, formed in the manifold 200. The passages 311, 312, and 313 communicate with passages 316, 317, and 318 in the manifold in which low pressure hand valves 321, 322, and 323 are located. Thus, the gas from each of the low pressure enclosures 31, 32, and 33 flows through the associated low pressure hand valve and into a common manifold passage 324. From the common manifold passage 324 the gas flow is into a connected line 326 into the molecular sieve 201. Gas flow is through the molecular sieve which removes the moisture and arc particles from the gas. Gas flow from the molecular sieve 201 is into a connector line 327 and thence to the compressor 202. The gas is pumped at relatively high pressure from the compressor 202 to an oil filter 328 which removes oil particles from the gas. A line 329 in which a solenoid valve 331 is connected returns oil removed from the gas to the compressor 202 when the compressor is not running. The gas at high pressure flows through an oil separator 328 and into a line 332 connected to a manifold passage 333. The high pressure gas flow continues through a check valve 334 located in the manifold passage 333 and out of the manifold via a passage 336 which communicates with the exterior at the back surface of the manifold. A connected line 337 receives the high pressure gas and directs it to a cartridge dessicant filter 338 that operates as a backup to oil filter 328 for oil removal from the high pressure gas. From the filter 338 the high pressure gas flows into a connected line 339 and is directed into a common high pressure gas passage 341 formed in the manifold 200. From the common high pressure manifold passage 341, the gas flows through three high pressure hand valves 342, 343, and 344 which are associated with the high pressure tanks 71, 72, and 73, respectively, of the separate circuit breakers 21, 22, and 23. The high pressure hand valves 342, 343, and 344 are disposed with the suitable passages formed in the manifold. Thus, the high pressure gas flows through valve 342 and out of the manifold via a manifold passage 346 into a connecting line 347. The line 347 communicates with the high pressure tank 71. In a similar manner, the high pressure gas flows through the valves 343 and 344 and via manifold passages 348 and 349 to which lines 351 and 352 are connected. The lines 351 and 352 are respectively connected to high pressure tanks 72 and 73 associated with circuit breaker phases 22 and 23. Thus, a completely closed system is provided with all valving being in a compact, easily accessible manifold located in the control cabinet 29 at the front of the breaker assembly.

In addition, the manifold 200 is provided with an internal passage 353 into which a sampling valve 354 is connected. The sampling is provided to take samplings of the gas from either high or low pressure sides so that the mositure content of the gas can be determined when desired. A service hand valve 356 connects the passage 353 to another manifold passage 357 that is in communication with yet another passage 358 in the manifold. One end of the passage 358 has a service connection 359 which provides a ready means for evacuating or filling the circuit breaker with the dielectric gas. At its inner end the passage 358 receives a hand valve 361, the opposite side of which communicates with a manifold passage 362 that is in communication with the common high pressure passage 341. The service hand valve 356 is closed during circuit breaker operation and provides access to the low pressure side from the service connection passage 358. The hand valve 361 in the manifold is also closed during circuit breaker operation. The valve 361 provides access to the high pressure side from the service passage or to the low pressure side when the hand valve 356 is opened. Normally, after filling the circuit breaker with gas the service connection 359 is capped.

Two other valves are located in the manifold. A relief valve 363 is located in a manifold passage 364 which is in communication with the common low pressure manifold passage 324 at one side of the valve. At the opposite side of the relief valve 363 the passage 364 is in communication with the common high pressure manifold passage 341. The valve 363 operates as a safety valve to bleed the high pressure gas into the low pressure area whenever all hand valves to the high pressure side are closed and pressure is built up to an unsafe level. A relief valve 366 in the common low pressure manifold passage 324 vents to atmosphere and bleeds the low pressure gas to atmosphere when all valves to the low pressure enclosures 31, 32, and 33 are closed, and pressure is built up to an unsafe level.

As previously mentioned, the pressure gauge PG-1 indicates the pressure in the low pressure side of the gas system. To this end, the gauge PG-1 is connected via a line 367 to a manifold passage that is in communication with the common low pressure manifold passage 324. On the other hand, the pressure gauge PG-2 indicates the pressure in the high pressure side of the gas system. Thus, the gauge PG-2 is connected via a line 369 to a manifold passage that is in communication with the common manifold high pressure passage 341.

Temperature guages TG-1 and TG-2 serve to indicate the temperature of the gas in the low pressure enclosure 31 and in the high pressure tank 71, respectively. To this end, a temperature sensor 372 located in the low pressure enclosure 31 is connected to the gauge TG-1. On the other hand, a temperature sensor 373 located in the high pressure tank 71 is connected to the gauge TG-2.

A temperature sensor 374 in the low pressure enclosure 31 is connected to the pressure switch PS-1 and provides temperature information thereto. A pressure sensor 376 associated with the switch PS-1 is connected by a line to a manifold passage which is in communication with the common low pressure manifold passage 324. The pressure switch PS-1 is operative to control the underpressure alarm circuit (not shown) and opens the compressor motor circuit (not shown) to prevent its operation when the low pressure falls below a safe level.

The required gas pressure for the high pressure system is maintained by control of the compressor 202 operation and the gas density. To this end, a temperature sensor 377 in the high pressure tank is connected to the temperature compensated pressure switch PS-2. A pressure sensor 378 of the switch PS-2 is connected via a line 379 to a manifold passage which is in communication with the common high pressure manifold passage 341. Thus, the switch PS-2 monitors the temperature and pressure of the high pressure system, and it is connected to the compressor control circuit (not shown) and controls compressor operation to maintain the desired high pressure level of the gas.

Gas density in the high pressure system is monitored by an underpressure alarm switch and an underpressure lockout switch which are incorporated in a single switch PS-3. A temperature sensor 381 is connected to PS-3 to provide continuous information of the gas temperature. A pressure sensor 382 associated with the PS-3 is connected via a line 383 to a manifold passage which is in communication with the common high pressure manifold passage 341. Thus, PS-3 monitors the temperature and pressure in the high pressure system and is operatively connected to effect the tripping of the circuit breaker and lock it in open position when the gas pressure in the high pressure system falls to an unsafe level.

The embodiments of the invention in which an exclusive property or privilege is claimed are defined as follows:

1. In a three-phase gas insulated circuit breaker having at least one interrupter per phase and each within a gas tight enclosure, said interrupters each having at least one movable contact;

an external pull rod box connected to each enclosure;

interrupter operating linkage within each of the pull rod boxes and operably connected to the movable contact of the interrupter within the enclosure;

a pull rod operably disposed to extend within each external pull rod box and connected to the interrupter linkage therein to effect the opening and closing operation of the associated interrupter, all of said pull rods being connected together in series relationship so as to move as a unit;

a single operator connected to effect operation of said series connected pull rods;

a first spring means operatively connected to the pull rod associated with said second phase circuit breaker;

a second spring means operably connected to the pull rod associated with said third phase circuit breaker;

the connection between said first and second spring means with their associated pull rods being such that the movement of said pull rods in a contact closing movement operates to compress said first and second spring means; and, means operably associated with each pull rod for effecting an adjustment thereof with relation to its associated interrupter contact wherein each pull rod moves a distance in a contact closing movement to effect the closing of its associated interrupter contact and the stored energy of said second spring means of said third phase is substantially totally utilized in the contact opening movement while the stored energy in said first spring means is only partially utilized;

whereby the initial movement of all of said pull rods in a contact closing movement is initiated by said first and second spring means but the entire energy stored in said first spring means is not expended so that excess velocity is not imparted to the pull rods to thereby avoid excessive shock loads to the system and said energy stored in said second spring means is substantially totally expended to effectively dampen contact bounce after the interrupter contacts have opened.

2. A circuit breaker arrangement according to claim 1 wherein said first and second spring means are each a plurality of nested coil springs arranged in coaxial relationship around said pull rods of said first and second phases, each of said first and second plurality of nested coiled springs being disposed within a phase related external pull rod box.

3. A circuit breaker according to claim 2 wherein there is provided an adjustable limiting stop in each of said external pull rod boxes to limit the movement permitted to each of said pull rods in a contact closing movement.

4. A circuit breaker according to claim 2 wherein there is provided a shock absorber in each of said external pull rod box to absorb the shock load of each of said pull rods as they move in a contact opening movement under the influence of said acceleration springs.

5. A three-phase gas insulated circuit breaker arrangement according to claim 1 wherein there is provided a contact velocity measuring means operably connected to be actuated by the movement of said pull rods in a contact opening movement.

6. In a three-phase gas insulated circuit breaker having at least one interrupter per phase and each within a gas tight enclosure, said interrupters each having at least one movable contact, each of the enclosures having a low pressure area and a high pressure area;

an external pull rod box connected to each enclosure;

interrupter operating linkage within each of the pull rod boxes and operably connected to the movable contact of the interrupter within the enclosure;

a pull rod operably disposed to extend within each external pull rod box and connected to the interrupter linkage therein to effect the opening and closing operation of the associated interrupter, all of said pull rods being connected together in series relationship so as to move as a unit;

a single operator connected to effect operation of said series connected pull rods;

a first spring means operatively connected to the pull rod associated with said second phase circuit breaker;

a second spring means operably connected to the pull rod associated with said third phase circuit breaker;

the connection between said first and second spring means with their associated pull rods being such that the movement of said pull rods in a contact closing movement operates to compress said first and second spring means;

means operably associated with each pull rod for effecting an adjustment thereof with relation to its associated interrupter contact wherein each pull rod moves a distance in a contact closing movement to effect the closing of its associated interrupter contact and the stored energy of said second spring means of said third phase is substantially totally utilized in the contact opening movement while the stored energy in said first spring means is only partially utilized;

whereby the initial movement of all of said pull rods in a contact closing movement is initiated by said first and second spring means but the entire energy stored in said first spring means is not expended so that excess velocity is not imparted to the pull rods to thereby avoid excessive shock loads to the system and said energy stored in said second spring means is substantially totally expended to effectively dampen contact bounce after the interrupter contacts have opened;

a control cabinet carried by said circuit breaker adjacent to the enclosure of one of the interrupters;

a two-pressure gas system for said circuit breaker including;

a manifold block disposed within said control cabinet, said manifold block having a plurality of passages defining a high pressure section and a low pressure section;

a plurality of valving, all of said valving being disposed in operative relationship in said manifold block;

external gas flow lines operatively connecting said manifold passages of said high pressure section to the high pressure areas of each of the interrupter enclosures of the circuit breaker; and, external gas flow lines operatively connecting said manifold passages of said low pressure section to the low pressure areas of each of the interrupter enclosures of the circuit breaker.

7. A three-phase gas insulated circuit breaker according to claim 6 wherein there is provided a molecular sieve connected to said low pressure section of said manifold block to receive gas at low pressure from each of the interrupter enclosures of the circuit breaker;

a compressor connected to receive gas at low pressure from said molecular sieve;

an oil filter connected to receive gas at a relatively high pressure from said compressor;

an external gas flow line connecting said oil filter to a passage in the high pressure section of said manifold block;

a check valve in said passage in said manifold block to which said oil filter is connected, said check valve operating to maintain pressure in the high pressure system;

a dessicant filter connected to said passage in said manifold block in which said check valve is disposed, said dessicant filter operating to remove oil vapor from the gas received from the high pressure system through said check valve;

an external gas flow line, connecting said dessicant filter to a passage in the high pressure section of said manifold block;

a plurality of hand valves in the passage in said manifold block to which said dessicant filter is connected, said valves being operable to divide the high pressure gas flow into a plurality of separate systems; and, individual external gas flow lines connecting said hand valves to the high pressure area of individual ones of the interrupter enclosures of the circuit breakers.

8. A three-phase gas insulated circuit breaker according to claim 7 wherein said low pressure section of said manifold block to which said molecular sieve is connected includes a plurality of low pressure hand valves;

external gas flow lines connecting the low pressure side of the individual interrupter enclosures of the circuit breaker to individual ones of said low pressure hand valves in said manifold block to provide for isolation of the low pressure gas in all or any individual interrupter enclosures of the circuit breaker;

a passage in said manifold interconnecting said high pressure section and said low pressure section; and a relief valve in said interconnecting passage and operable to bleed high pressure gas to the low pressure section when all of said hand valves in said manifold block are closed.

9. A three-phase gas insulated circuit breaker according to claim 8 wherein there is provided in said control cabinet adjacent to said manifold block;

a first temperature gauge operably connected to indicate the temperature of the gas in the low pressure area of the interrupter enclosures of the circuit breaker;

a second temperature gauge operatively connected to indicate the temperature of the gas in the high pressure area of the interrupter enclosures of the circuit breaker;

a first pressure gauge operatively connected to indicate the pressure of the gas in the low pressure area of the interrupter enclosures of the circuit breaker;

a second pressure gauge operatively connected to indicate the pressure of the gas in the high pressure area of the interrupter enclosures of the circuit breaker;

a first density switch operably connected to monitor the density of the gas in the low pressure area of the interrupter enclosures of the circuit breaker, said first density switch being operable to render the compressor inoperable when the density of the gas being monitored falls below a predetermined value;

a pressure compensated pressure switch operably connected to monitor the pressure of the gas in the high pressure area of the interrupter enclosures of the circuit breaker, said compensated pressure being operable when the pressure of the gas being monitored falls below a predetermined level to effect the operation of said compressor; and, a second gas density switch operably connected to monitor the density of the gas in the high pressure area of the interrupter enclosures of the circuit breaker, said second density switch being operable to effect the operation of the interrupters to open them and maintain them in open position when the density of the gas falls below a predetermined density value.

10. In a three-phase gas insulated circuit breaker having three gas tight enclosures, one per phase, in which there is provided at least one pair of separable contacts per enclosure movable to a full open position and a full closed position;

actuating means associated with each enclosure and operably connected to effect the movement of the movable contact to a closed position or to an open position;

operable means connecting the actuating means associated with each enclosure together in a manner that all of said actuating means operate in unison;

accelerator means associated with two of said actuating means for biasing said actuating means to move said movable contacts to open positions; and, restricting means operably carried by one of said actuating means in position to restrict the full expansion of the accelerator means associated with the particular actuating means after all of said actuating means have operated to effect a separation between the contacts but before the separable contacts are moved to full open position;

whereby all of said accelerators operate on said actuating means to impart an initial acceleration to the contacts to effect a rapid separation of the contacts, but when contact separation has been accomplished, the energy of one of the accelerators is removed to reduce the velocity of the moving contacts.

11. A three-phase gas insulated circuit breaker according to claim 10 wherein there is provided a shock absorbing means within each enclosure, said shock absorbers being operably disposed to be engaged by the associated actuating means when they have operated to effect a separation of the contacts but before said contacts are moved to full open position;

whereby a slowing down of the moving contacts occurs prior to the contacts reaching a full open position thereby materially reducing the shock load on the system.

12. In a three-phase gas insulated circuit breaker having at least one interrupter per phase and each within a gas tight enclosure;

an internal pull rod box connected to each enclosure;

interrupter operating linkage within each of the pull rod boxes and operably connected to the interrupter within the enclosure;

a pull rod operably disposed to extend within each external pull rod box and connected to the interrupter linkage therein to effect the opening and closing operation of the associated interrupter, all of said pull rods being connected together in series relationship so as to move as a unit;

a single operator connected to effect operation of said series connected pull rods;

a first spring means operatively connected to the pull rod associated with said second phase circuit breaker;

a second spring means operably connected to the pull rod associated with said third phase circuit breaker;

the connection between said first and second spring means with their associated pull rods being such that the movement of said pull rods in a contact closing movement operates to compress said first and second spring means; and, means operably associated with each pull rod for effecting an adjustment thereof with relation to its associated interrupter contact wherein each pull rod moves a distance in a contact closing movement to effect the closing of its associated interrupter contact and the stored energy of said second spring means of said third phase is substantially totally utilized in the contact opening movement while the stored energy in said first spring means is only partially utilized;

whereby the initial movement of all of said pull rods in a contact closing movement is initiated by said first and second spring means but the entire energy stored in said first spring means is not expended so that excess velocity is not imparted to the pull rods to thereby avoid excessive shock loads to the system and said energy stored in said second spring means is substantially totally expended to effectively dampen contact bounce after the interrupter contacts have opened;

a contact velocity measuring means carried by an external pull rod box, said velocity measuring means including a resistance coil;

a slider movable over said resistance coil and operable to indicate the change of resistance of said coil with movement, a movement of said slider relative to said coil; and, operable means connecting said slider to said pull rods for movement with said pull rods.

* * * * *